US005242364A

United States Patent [19]

Lehmann

[11] Patent Number: 5,242,364

[45] Date of Patent: Sep. 7, 1993

[54] PAPER-FOLDING MACHINE WITH ADJUSTABLE FOLDING ROLLERS

[75] Inventor: Werner Lehmann, Gutach, Fed. Rep. of Germany

[73] Assignee: Mathias Bäuerle GmbH, Georgen/Schw., Fed. Rep. of Germany

[21] Appl. No.: 857,384

[22] Filed: Mar. 25, 1992

[30] Foreign Application Priority Data

Mar. 26, 1991 [DE] Fed. Rep. of Germany ..... 4109861

[51] Int. Cl.[5] ..... B65H 45/14

[52] U.S. Cl. ..... 493/8; 493/18; 493/34; 493/15; 493/421

[58] Field of Search ..... 493/8, 13-15, 493/17, 18, 23, 34, 419, 420, 421

[56] References Cited

U.S. PATENT DOCUMENTS

| | | | |
|---|---|---|---|
| 2,414,386 | 1/1947 | Olson | 493/420 |
| 3,021,134 | 2/1962 | Appell | 493/420 |
| 3,975,009 | 8/1976 | Brown | 493/14 |
| 4,099,710 | 7/1978 | Boyer | 493/420 |

FOREIGN PATENT DOCUMENTS

| | | |
|---|---|---|
| 2738689 | 3/1979 | Fed. Rep. of Germany . |
| 2757182 | 6/1979 | Fed. Rep. of Germany . |
| 390287 | 4/1965 | Sweden . |

*Primary Examiner*—Bruce M. Kisliuk
*Assistant Examiner*—Jack Lavinder
*Attorney, Agent, or Firm*—McGlew and Tuttle

[57] ABSTRACT

A paper-folding machine with a plurality of folding rollers, which form a folding station in pairs and the distances between whose axes can be set to different folding gap widths corresponding to the paper thickness to be processed and the number of layers of paper passing through the individual folding stations, as well as with mechanical or electronic feed limiters, which are arranged in front of the individual folding stations and can be set individually to different feed lengths. The thickness of the incoming material to be folded, which is determined by means of a thickness-measuring device (40), and the sheet length of the arriving material to be folded, which is determined by a length-measuring device (41), as well as the desired type of folding and/or the set feed lengths of the individual feed limiters (T1-T4), are entered into a process computer (20) to determine the folding gap widths of the individual pairs of folding rollers (W1-W5). The folding gap widths determined are always displayed in digital form and/or sent to a follow-up control device (35), for which they serve as set values for continuously adjusting the individual distances (a) between the axes to these folding gap widths that correspond to a single or multiple thickness of the material to be folded.

5 Claims, 2 Drawing Sheets

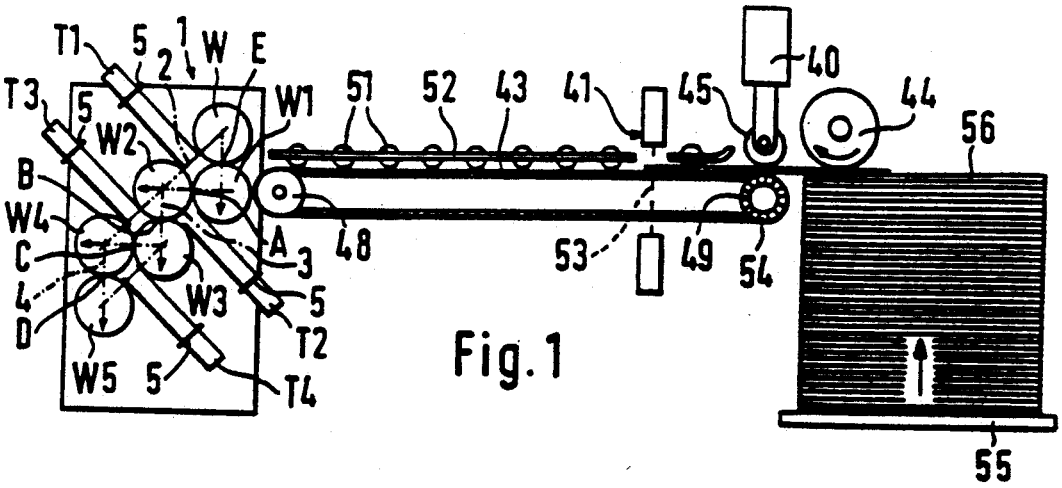
Fig. 1
Fig. 2
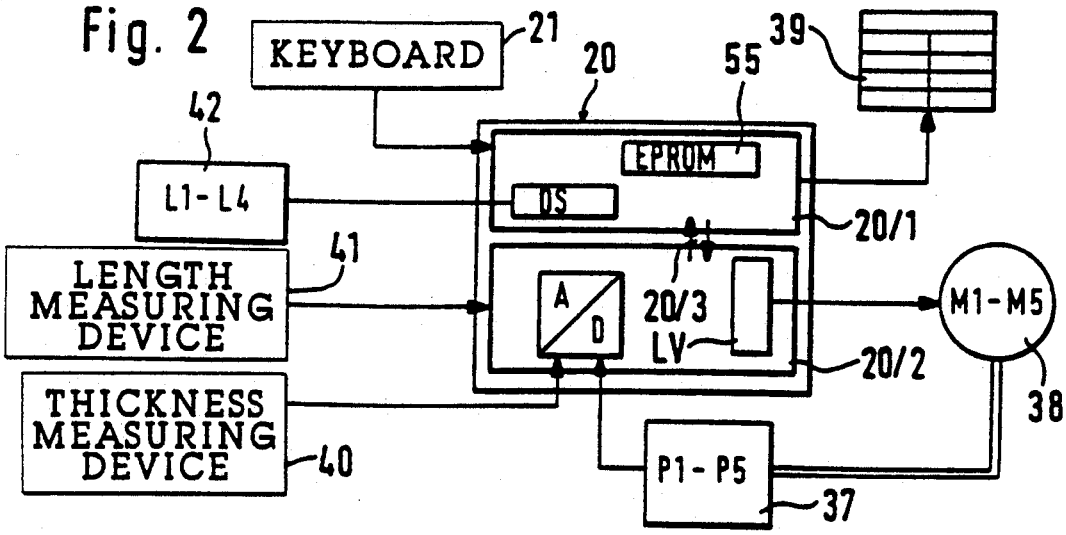
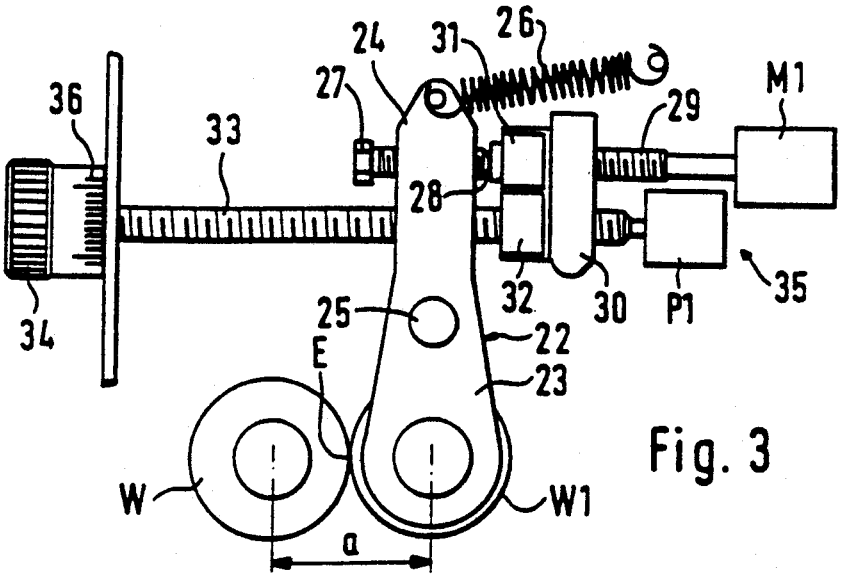
Fig. 3

PAPER-FOLDING MACHINE WITH ADJUSTABLE FOLDING ROLLERS

FIELD OF THE INVENTION

The present invention pertains to a paper-folding machine with a plurality of folding rollers, which form in pairs a folding station each and are mounted in bearing brackets of two-armed pivoted levers which can be moved away from one another against the action of radial spring forces, and whose second lever arms can be lifted off by adjusting means, with which the distances between the axes of the folding rollers can be adjusted to different folding gap widths corresponding to the paper thickness to be processed and the number of paper layers passing through the individual folding stations by means of self-locking, manually adjustable threaded contacts, as well as with mechanical or electronic feed limiters, which are arranged in front of the individual folding stations and can be individually adjusted to different feed lengths.

BACKGROUND OF THE INVENTION

A paper-folding machine of this class has been known (Swiss Patent No. 390,287), in which the pivoted levers, on which the folding rollers are mounted, are in spring-like contact with a lever arm at the end of a rod-shaped, axially movably mounted contact element, whose other end is in liftable contact with the front surface of an adjusting means. This adjusting means is designed as a threaded bolt, which can be adjustably screwed into a threaded bore of a bearing part, which threaded bore is coaxial with the axis of the contact element. To set the actually desired folding gap width, small plates, whose thickness corresponds to the folding gap width to be set, are placed as intermediate layers between the contact element and the front face of the threaded bolt facing the contact element. The threaded bolt, which is provided with a turning, serves only for correcting adjustment of the contact element, in order to finely adjust the folding gap width set with the intermediate layers upward or downward corresponding to the other properties of the paper.

In this and other prior-art paper-folding machines of this class, the distances between the axes of the folding roller pairs folding the individual folding stations can be adjusted only manually, after the user determined the number of paper layers in which the paper being folded will pass through the individual folding stations. This may be done on the basis of the paper thickness known or determined, as well as on the basis of the type of folding set. However, it should be considered that all folding stations, which will also be passed through by a trailing, one-layer folding material section, can be set only to the thickness of a single layer of paper, because otherwise the frictional drive required for folding this folding material section trailing as a single layer would no longer be guaranteed.

A considerably greater accuracy of the folding operation can be achieved when the distances between the folding rollers forming in pairs one folding station are set to a folding gap width that corresponds to the value determined by the paper thickness and the number of layers with which the material being folded passes through the folding station in question. Accordingly, it is important to make it possible to set every individual folding station to the corresponding folding gap width. However, it is difficult to accomplish this task according to the prior-art, manual method, because an average person skilled in the art, to whom only the type of folding, the paper thickness, and possibly the paper length of the initial format are known, has a difficult time determining the correct folding gap width of every individual folding station. Correspondingly, such incorrect settings are also frequent on such folding machines in practice.

SUMMARY AND OBJECTS OF THE INVENTION

It is a primary object of the present invention to facilitate the setting and/or determination of the folding gap widths of the individual folding stations that correspond to a defined paper thickness, paper length, and the type of folding in a paper-folding machine of this class, and to make it fault-free while guaranteeing reliable paper transport through all folding stations as well as the highest possible reliability of operation.

According to the present invention, to determine the folding gap widths of the individual folding roller pairs, a programmable process computer with an entry keyboard is provided. Data is entered into the process computer including the thickness and the sheet length of the arriving material to be folded along with the desired type of folding and/or the set feed length of the individual feed limiters. These data are entered either manually or via electronic analog-digital converters from a thickness-measuring device and a length-measuring device, respectively. The folding gap widths are computed by the process computer according to a program based on the values entered these may be displayed as digital values and/or sent to a control unit provided with electronic comparator circuits and power amplifier stages, which control unit controls electric geared motors of follow-up control devices, which motors bring about—via the respective threaded contacts provided—the continuous adjustment of the individual distances between the axes to these folding gap widths that correspond to the actual single or multiple thickness of the material being folded. The motors are actual value transducers having electric or electronic position indicators (transducers), which are connected to respective adjusting means.

The linkage or utilization of the individual parameters, namely, the paper thickness, the paper length, and the number of paper layers in the individual folding stations, which is determined by the type of folding selected, is performed in the process computer according to an entered program, e.g., a program stored in an erasable programmable read only memory (EPROM, i.e., an erasable program command memory), and by means of coincidence processes, which are part of the program. To store or buffer the external values, it is also necessary to have available electronic memories, which are integrated within the process computer in the usual manner. With a suitable subroutine, the process computer is also able to determine, from the paper length entered and the type of folding entered, the number of layers in which the material being folded will pass through the individual folding stations, and whether the same material being folded will pass through a given folding station first in two or more layers and then, over a trailing section, only as a single layer.

In the conventional folding machines, these preset values, which are necessary for correct setting of the folding gap widths, are determined by the user and are then taken into account at the time of the manual setting.

In buckle folding machines, the feed limiters are usually designed as folding pockets with mechanically or electrically adjustable paper stops. However, there are also buckle folding machines in which stopless feed limiters with electronically presettable feed lengths are provided. In both cases, the settings of the individual feed lengths can be made available to the process computer as parameters in the form of digital values for determining the individual folding gap widths.

Buckle folding machines with a plurality of folding roller pairs and folding pockets are also known, in which a process computer computes the working positions of the paper stops and of the paper deflectors by entering the initial format of the material to be folded, the final format of the folded material, and the type of folding, and in which these values, computed by the process computer, and used to continuously adjust the paper stops by means of a follow-up control device (DE 27,38,689 C3). In addition, it is also known in buckle folding machines that in order to control the feed limiters that can be actuated by means of electromagnets according to the proper folding length, it is possible to provide an electronic impulse generator, which is synchronized with the folding rollers and is controlled by folding material sensors. This type of feed limiter operates withoutn stops (DE 27,57,182 C2). Using the electronic impulse generator and the folding material sensors controlling, the leading section of the actually leading folding material section is determined, in principle, by means of a coincidence circuit which induces the stopping movement of the corresponding decelerating or locking members. By means of a keyboard or by a process computer, the coincidence circuit can be set to the pulse count at which the feed limiters are actuated. Thus, length measurement is performed in this case as well.

However, these prior-art computer-aided processes have nothing to do with the setting and determining of defined folding gap widths at the individual folding stations of a folding machine. They are used merely to determine the feed section, i.e., only one of several initial values, which are needed for determining the actual correct folding gap width at the individual folding stations.

The principal advantage that is achieved with the present invention is the fact that substantial facilitation and, above all, a substantially higher reliability are achieved during the setting of the correct distances between the axes even when the actual setting of the distances between the axes is performed manually, because these values, which are to be set, are determined and displayed by the process computer. This means that this principal advantage can also be achieved at a relatively low expense. However, it is additionally also possible to perform fully automatic programming of a buckle folding machine for every desired folding operation, taking into account the actually optimal folding gap widths at the individual folding stations.

While it is basically possible to determine the paper thickness and the sheet length by means of corresponding measuring devices and to directly enter them, if desired, as digital values into the process computer via electronic analog-digital converters, these values may also be entered, if they are known, manually via the existing keyboard.

The setting mechanism provided according to the present invention is of great advantage especially in cases in which the distance between the axes of a pair of rollers must be set to a folding gap width that corresponds to only one paper thickness, even though the folding station in question will also be passed over by the material being folding in multiple layers. In addition, it makes it possible, in a simple manner, to accurately set the actually desired folding gap width and to nevertheless ensure radially elastic mounting of the individual folding rollers, which will make it possible in the first place for a multilayer folding material, i.e., a multiple of the thickness of one sheet of paper, to pass through a folding station that is set to a folding gap width corresponding to the thickness of one sheet of paper, and will nevertheless operate reliably and with optimal fold formation.

The present invention proposes an embodiment with an advantageous arrangement of the thickness-and length-measuring device in a feed path, which is usually present anyway, and is used to longitudinally adjust the material to be folded along a guide bar.

The present invention proposes an embodiment for a simple design solution for the adjustable mounting of the individual folding rollers.

A further advantageous embodiement of the present invention makes it possible to achieve, by using simple means, simple handling and digital display of the folding gap widths actually set even if they were set manually.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a schematically simplified representation of a side view of a buckle folding machine with an aligning section arranged in front of it for the material to be folded, which is to be fed in from a stack;

FIG. 2 is a block diagram of the electric or electronic control device;

FIG. 3 is a simplified representation of the adjusting mechanism of a folding roller;

DETAILED DESCRIPTION OF THE PREFERRED EMBODIMENT

The buckling folding machine 1, which is only schematically shown in FIG. 1, has a total of five folding rollers W1 through W5 and additionally one intake roller W, which forms, together with the folding roller W1, an intake site E at the point where the two rollers W and W1 touch each other or where they are at the smallest distance from one another. The folding roller W1 forms with the folding roller W2 the first folding station A; the second folding roller W2 forms with the third folding roller W3 the second folding station B; the third folding roller W3 forms with the fourth folding roller W4 the third folding station C; and the fifth folding roller W5 forms with the fourth folding roller W4 the folding station D. The axes of the intake roller W and of the folding rollers W1 through W5 are located in the corners of isosceles, rectangular triangles 2, 3, and 4, which are shown by dash-dotted lines in FIG. 1. While the intake roller W is mounted stationarily and non-adjustably, each of the folding rollers W1 through W5 is adjustable, radially to the folding rollers with which they cooperate and form either the intake site E or a folding station A through D, radially in the direction of the arrows shown in FIG. 1. This allows the intake gap at the intake site E to be able to be set to the thickness of the paper to be folded, and for the folding gaps at the folding stations A through D to be able to be set to corresponding folding gap widths. The folding rollers W1, W3, and W5 are adjustable in the vertical direction radially to the respective superjacent rollers W1 or W2 or W4, while the folding rollers W2 and W4 are adjustable in the horizontal direction radially to the folding rollers W1 and W3.

Since the maximum adjustment paths or folding gap widths are on the order of magnitude of 1 mm or less, and the folding rollers usually have diameters of about 35 to 40 mm or more, the displacements occurring during the adjustment in the circumferential direction of the opposite roller do not affect the quality of folding, provided, of course, that the parallel course of the axes is preserved.

Figure 4:
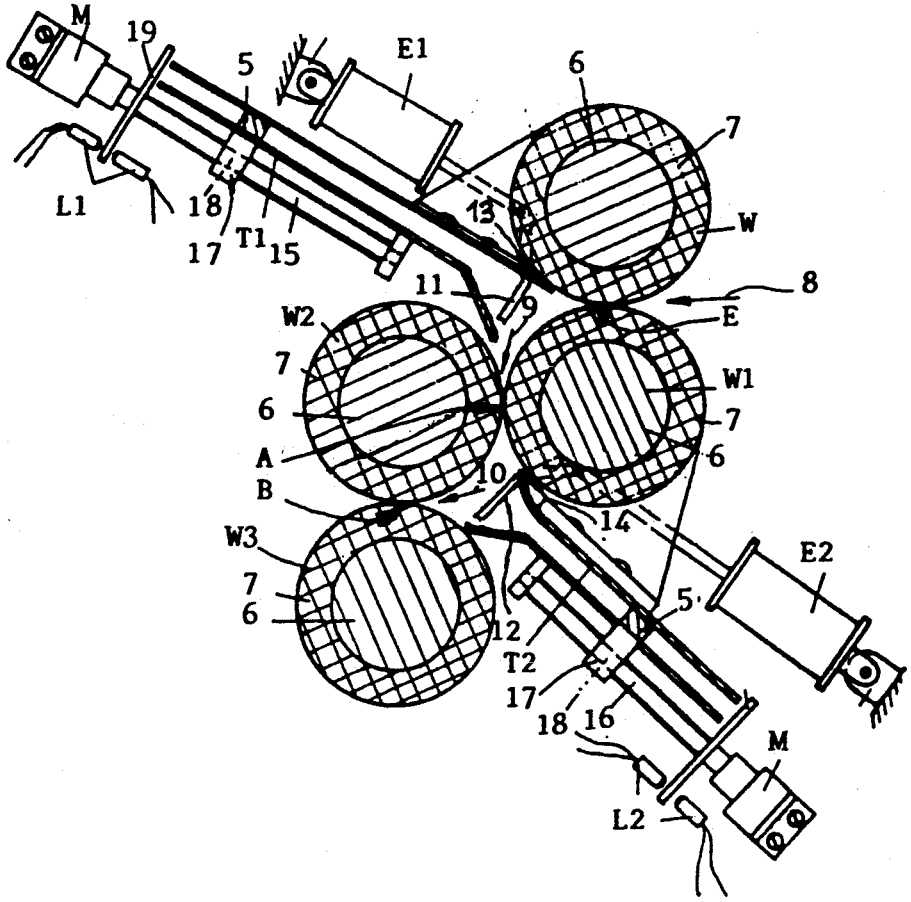
FIG. 4 is a schematic cross sectional view through a buckle folding machine with two folding pockets, whose stops are automatically adjustable.

The folding pockets T1, T2, T3, and T4, which are arranged in front of the respective folding stations A through D, have respective stops 5, which can be set to different feed lengths manually or by means of a follow-up control device according to FIG. 4. For simplicity's sake, only two folding pockets T1 and T2 are shown in FIG. 4 together with the folding rollers W1, W2, and W3, and the intake roller W, which form the folding stations A and B. The folding pockets T3 and T4 advantageously have the same design. The intake and folding rollers W-W3 shown in FIG. 4 each consist of a metal core 6 and a casing 7 made of an elastic material of a defined hardness. However, it is possible to use other rollers as well, e.g., all-metal rollers which have have sections of an elastic material between all-metal sections.

The material being folded passes through the intake site E and the two folding stations A and B consecutively in the directions indicated by the arrows 8, 9, and 10. To prevent the material being folded from being taken into the folding pockets T1, T2, to achieve, if necessary, a certain type of folding, these the folding pockets T1 and T2 are provided on their intake sides with paper deflectors 11 and 12, respectively (this applies to the folding pockets T3 and T4 as well), which are each pivotably mounted around respective axes 13 and 14 extending in parallel to the folding rollers W1, W4. Both the paper deflectors 11 and 12 can be actuated by electromagnets E1 and E2, respectively, so that they optionally close or keep open the intake openings of the folding pockets T1 and T2.

Figure 5:
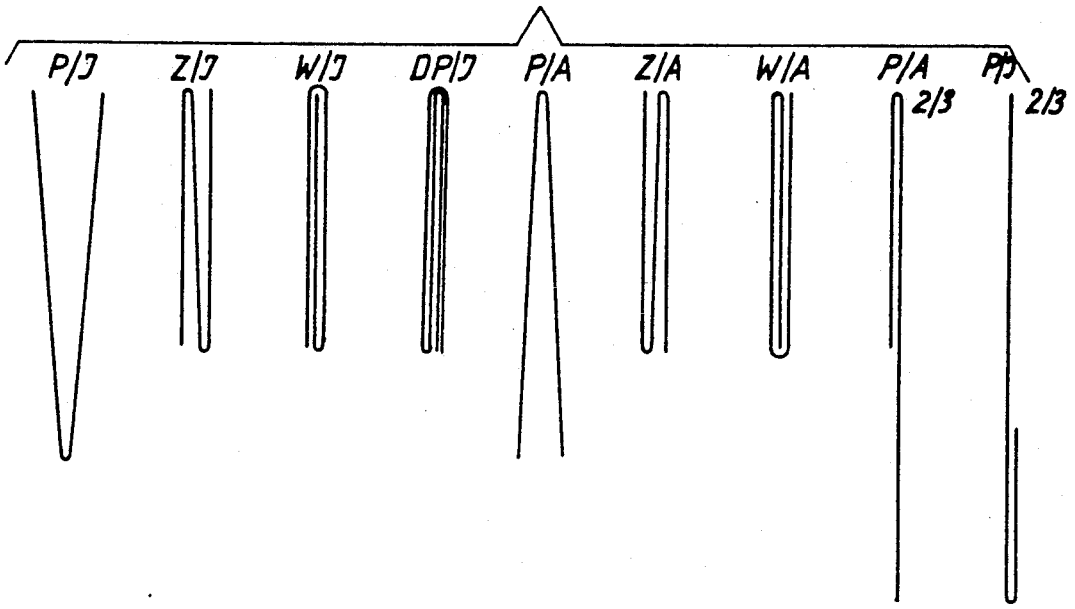
FIG. 5 is a schematic cross sectional view of various folding patterns.

To adjust and position the paper stops 5 in the folding pockets T1 and T2, threaded spindles 15 and 16, respectively, are provided, and they are arranged extending in parallel to the folding pockets T1, T2 and are mounted axially stationarily and rotatably. The paper stops 5 are each provided with an adjusting base 17, which has a threaded bore 18, into which the threaded spindle 15 or 16 is screwed. The threaded spindles 15, 16 are each in drive connection with an electric motor M with reversible direction of rotation, and are provided with an impulse disk 19 each, which is scanned by a respective photocell L1 and L2. With the respective photocell L1 and L2, the impulse disks 19 form an impulse generator, from which not onlyu the angle of rotation, but also the direction of rotation of the threaded spindle 15 or 16 can be determined. The electromagnets E1 and E2, as well as the electric motors M of the threaded spindles 15 and 16 are controlled by a process computer 20, into which all the data needed for setting the feed lengths in the individual folding pockets and for determining the individual folding gap widths, e.g., the length of the basic format of the material to be folded, the folding pattern, and the desired length of the final format, can be entered via a connected keyboard 21, wherein a total of nine different folding patterns, which are schematically shown in FIG. 5, can be selected. Key to symbols:

P—simple parallel fold
Z—z-shaped folding pattern
DP—double parallel fold
W—spiral fold
A—top side of the folded material lying inside.

As can be recognized from the schematic representation in FIG. 2, the process computer 20 consists of a main processor (master processor) 20/1 and a subordinate, second processor (slave processor) 20/2. The keyboard 21, via which the operator is able to enter the set values or the parameters, is connected to the master processor 20/1. In addition, a digital display device in the form of a display 39, which may have a plurality of display fields for displaying the current actual values of the feed lengths, folding gap widths, and the type of folding just set, is connected to the master processor. Moreover, the master processor is able to store values or parameters that are necessary for operating the machine even when it is tuned off, so that these do not have to be re-entered each time, as long as it does not want to update, i.e., change them.

For this purpose, it is provided with an electronic memory DS, in which these values and parameters are kept available, ready to be polled, for computing the folding gap widths to be determined, and to which the four actual value transducers consisting of the photocells L1, L2, and the associated impulse disks 19 are connected as the input unit 42. Since there are four actual value transducers in the four folding pockets T1 through T4 in this case as well, the input unit 42 contains the legend L1-L4.

The working program of the process computer 20, by which the determination or computation of the desired values from the above-mentioned parameters is performed, is contained in an EPROM, i.e., an erasable program command memory.

The second processor 20/2 executes the actual setting of the folding gap widths and, if desired, also the setting of the feed lengths, e.g., by correspondingly setting the paper stops 5 in the folding pockets T1 through T4. The second processor 20/2 is connected to the master processor via an interface 20/3 for exchanging data, and is provided with an output-side power amplifier LV, via which it controls the electric motors M for setting the paper stops 5 and/or the geared motors M1 through M5 for setting the folding gap widths. Both analog position indicators P1 through P5 of adjusting shafts 33 and an automatic paper thickness-measuring device 40 may be connected to the second processor 20/2 via an analog/-digital converter unit A/D, while an automatic paper length-measuring device 41 is directly connected to it.

As can be recognized from the folding patterns shown schematically in FIG. 5, the number of paper layers with which the material being folded passes through the individual folding stations A through D may differ. This means that the folding gap widths of the individual folding stations A through D, if they are to be set optimally, can correspond to one to four times the thickness of a single sheet of paper. It should also be borne in mind that the paper thicknesses of the folding material to be actually processed may greatly vary.

To set these optimal folding gap widths or the folding gap widths necessary for achieving a higher accuracy of folding, an adjusting mechanism each, which is represented, e.g., in FIG. 3 for the folding roller W1 for setting the gap width at the intake site E, is provided for the individual folding rollers W1 through W5 at both ends of the roller.

As was mentioned above, the intake roller W is mounted rotatably and stationarily, i.e., in radially immobile bearings. In contrast, the first folding roller W1 is mounted, like the other folding rollers W2 through W5, on a lever arm 23 of a bearing part 22. This structure comprises a two-armed pivoted lever, in which the bearing part 22 is pivotable around a swivel bearing 25 extending in parallel to the axis of the roller, and whose second lever arm 24 is under the action of a draw spring 26 such that the folding roller W1 is pressed radially against the intake roller W. To change the distance a between the axes and to set a certain gap width at the intake site E, the second lever arm 24 of the bearing part 22 is provided with an adjusting screw 27, which is in contact with the front surface 28 of a threaded spindle 29 provided with fine threads. The threaded spindle 29 engages an internal threaded section 29' of a stationary step bearing 30, and is also provided with a pinion 31, by which it is in drive connection with an adjusting shaft 33, which may also be actuated manually, via a second pinion 32. The adjusting shaft 33 is provided with a turning knob 34, and it is also connected to the adjusting means (not shown) of a position indicator P1. The position indicator comprises a potentiometer and reports, as an analog actual value transducer, the actual setting of the threaded spindle 29, and consequently also the folding gap width at the intake site E, to the processor 20/2. The threaded spindle 29 is in direct rotary connection with the reversible geared motor M1, by which it can be adjusted and controlled by the processor 20/2, in one direction or the other. However, this adjustment of the threaded spindle 29 may alternatively also be performed manually via the manual setting member consisting of the adjusting shaft 33 and the turning knob 34. The turning knob is provided with a scale 36 for this purpose.

The threaded spindle 29, the geared motor M1, and the position indicator P1, whose adjusting means is in rotary connection with the threaded spindle 29 via the adjusting shaft 33, represent a continuously adjusting follow-up control device 35. This allows the automatic setting of the axial distance a between the folding roller W1 and the intake roller W, and also manual setting of the distance a between the axes, are possible, with simultaneous digital display of the current actual position or the current actual folding gap width in the display 39.

The other folding rollers W2 through W5 can also be adjusted analogously horizontally and vertically in the directions of the arrow shown in FIG. 1, for which further geared motors M2 through M5 and position indicators P2 through P5 are used. Therefore, the legend P1–P5 is associated with the circuit component 37 in FIG. 2, and the legend M1–M5 is associated with the circuit component 38.

In FIG. 1, a paper length-measuring device 41 is schematically represented in a feed path 43 serving as an aligning section, which consists of a photocell 53 and an impulse disk 54, as well as corresponding electronic counting members. In addition, the electronic paper thickness-measuring device 40 provided with a jockey roller 45 is arranged as shown in FIG. 1 between a sheet decollating device 44 represented in a simplified manner, which removes the material to be folded as single sheets from a sheet stack 56 of an ascending table 55 and transfers it into the feed path 43, and the photocell 53. The paper thickness-measuring device 40 is provided with an inductive, i.e., analog transducer, whose measured values are sent, as was described above, via the analog-digital converter unit A/D to the processor 20/2 and from this to the master processor via the interface 20/3.

The feed path 43 is formed by the carrying run 47 of an endless conveyer belt 50 led around two belt drums 48 and 49, with which pressing balls 51 of a flat ball cage 52 are in loose contact in the known manner to guarantee the necessary carrying friction.

To determine the folding gap widths actually to be set at the intake site E or at the individual folding stations A through D, the parameters needed to determine, automatically set and/or display the optimal folding gap widths at the intake site E and at the individual folding stations A through D are entered into the process computer either manually via the keyboards 21 and/or 46 or through the paper thickness-measuring device 40 and the paper length-measuring device 41, as well as through the input unit 42. These parameters are the paper thickness, the paper length, and the feed lengths or positions of the paper stops 5 in the individual folding pockets T1 through T4, which feed length or positions are determined by the selected folding pattern, and, as was mentioned, it is possible to determine all these parameters with electronic measuring devices or actual value transducers and to enter them in digital form into the process computer 20.

Due to its stored working program, the process computer 20 is also able to take into account whether and if so, in which folding station A through D the folding gap width may be set only to the thickness of a single sheet of paper because of the trailing movement of a single-layer section of material being folded, despite a preceding passage of a multilayer folding material. The user of a folding machine thus equipped has not only the advantage of saving much time, but also the certainty that the folding machine as a whole is set optimally corresponding to the folding program selected.

The working program contains a mathematical computation procedure which reproduces or performs in advance the complete folding process taking place in the machine. For example, the individual feed lengths are thus pulled from the initial length of the paper sheet one after another. A check is then performed to determine how many layers of paper are formed by this folding process. After the number of layers of paper has thus been determined, it can be multiplied by the parameter "paper thickness" and converted into the folding gap width for each pair of rollers.

If these folding gap widths are not only displayed, but also used to control the geared motors M1–M5 at the same time, this is performed according to the follow-up control method by the actual positions being reported the position indicators P1–P5 to the processor and being compared with the calculated values until coincidence is achieved.

While specific embodiments of the invention have been shown and described in detail to illustrate the application of the principles of the invention, it will be understood that the invention may be embodied otherwise without departing from such principles.

I claim:

1. A paper folding machine, comprising:

a plurality of folding rollers cooperating in pairs to form folding stations between adjacent folding rollers; a plurality of two-armed pivot levers, each being mounted for pivoting about a pivot and including a bearing bracket supporting one of said folding rollers for moving the folding roller radially relative to an adjacent folding roller forming one of said folding stations; a plurality of radial springs, each radial spring being connected to one of said two-armed pivot levers on a side of said pivot opposite said bearing bracket, providing a radial spring force; a plurality of adjusting means, each roller being connected to an adjusting means for selectively moving said folding rollers radially to vary distances between axes of said adjacent folding rollers, said distance between said axes corresponding to folding gap widths based on a thickness of an element to be folded, said thickness being based on a sheet thickness of the element to be folded and on a number of layers to pass through an individual folding station, each of said adjusting means including a selflocking, manually adjustable threaded drive connected to said two-armed pivot lever and including an electric geared motor connected to said threaded drive for rotating said threaded drive in each direction to provide an automatic continuous adjustment of individual distances between axes to provide varying folding gap widths and an electronic position indicator connected to said threaded drive for providing feedback information regarding an actual position of said threaded drive; means arranged in front of individual folding stations to set different feed lengths of sheets to be folded; programmable processing means including a keyboard, a computer and a digital display, said programmable processing means for receiving data including thickness and sheet length of arriving material to be folded, a desired type of folding, and said set feed lengths and for computing folding gap widths based on data received, and for displaying said folding gap widths as digital values for generating a control signal; and control means including electronic comparator circuits and a power amplifier stage, said control means for receiving said control signal and controlling each said electric geared motor to achieve said computed folding gap widths.

2. A paper-folding machine in accordance with claim 1, wherein, said data including thickness and sheet length of arriving material to be folded is provided by a thickness-measuring device and a length-measuring device which are arranged in a feed path located between a sheet decollating device and an intake site formed by an intake roller and one of said plurality of folding rollers.

3. A paper-folding machine in accordance with claim 1, wherein said adjusting means and said electronic position indicators are in non-rotating mechanical connection with a common manual adjusting member and are adjusted jointly by said common manual adjusting member.

4. A paper-folding machine in accordance with claim 3 wherein, said plurality of folding rollers are arranged in relation to one another such that the axes of three folding rollers are located in the respective corners of an isosceles, rectangular triangle, the axes being at ends of legs of said triangle and one folding roller of each folding roller pair is adjustable in the direction of one of said legs, and another folding roller of said folding roller pair is adjustable in a direction of another of said legs.

5. A paper folding machine, comprising:

an intake roller; a first folding roller positioned adjacent said intake roller to define an intake station first based on an intake gap defined between said intake roller and said first folding roller; a second folding roller positioned adjacent said first folding roller to define a first folding station based on a folding gap defined between said first folding roller and said second folding roller; a third folding roller positioned adjacent said second folding roller to define a second folding station based on a folding gap defined between said second folding roller and said third folding roller; a first two-armed pivot lever including a pivot, a bearing bracket connected to said first folding roller; a first radial spring connected to said two-armed pivot lever on the side of said pivot opposite said bearing bracket; a first adjusting means connected to said first two-armed pivot lever for pivoting said first two-armed pivot lever to move said first folding roller radially to vary a distance between said first folding roller and said intake roller to vary a size of said intake gap, said adjusting means including a manually adjustable threaded drive connected to said first two-armed pivot lever and a electric geared motor for rotating said threaded drive in each direction thereby providing an automatic continuous adjustment of said intake gap and an electronic position indicator connected to said threaded drive for providing feedback information regarding an actual position of said threaded drive; a first folding pocket disposed adjacent said folding gap of said first folding station, said first folding pocket including means for setting different feed lengths of a sheet to be fed to said second folding station; a second two-armed pivot lever including a pivot, a bearing bracket connected to said second folding roller; a second radial spring connected to said second two-armed pivot lever on the side of said pivot opposite said bearing bracket; second adjusting means connected to said second two-armed pivot lever for pivoting said second two-armed pivot lever to move said second folding roller radially to vary a distance between said second folding roller and said first roller to vary said first folding station folding gap, said second adjusting means including a manually adjustable threaded drive connected to said second two-armed pivot lever and a electric geared motor for rotating said threaded drive in each direction thereby providing an automatic continuous adjustment of said first folding station folding gap and an electronic position indicator connected to said threaded drive for providing feedback information regarding an actual position of said threaded drive; a second folding pocket disposed adjacent said folding gap of said second folding station, said second folding pocket including a movable stop defining means for setting different feed lengths of a sheet to be fed to said second folding station; a third two-armed pivot lever including a pivot, a bearing bracket connected to said third folding roller; a third radial spring connected to said third two-armed pivot lever on the side of said pivot opposite said bearing bracket; third adjusting means connected to said third two-armed pivot lever for pivoting said third two-armed pivot lever to move said third folding roller radially to vary a distance between said third folding roller and said second roller to vary said second folding station folding gap, said third adjusting means including a manually adjustable threaded drive connected to said second two-armed pivot lever and a electric geared motor for rotating said threaded drive in each direction thereby providing an automatic continuous adjustment of said second folding station folding gap and an electronic position indicator connected to said threaded drive for providing feedback information regarding an actual position of said threaded drive; data input means for input of sheet thickness and folding type and for generating a folding gap width control signal based on input data; and control means for controlling said electric geared motor based on said control signal.

* * * * *